US007242418B2

(12) United States Patent
Takasaka

(10) Patent No.: US 7,242,418 B2
(45) Date of Patent: Jul. 10, 2007

(54) THERMAL TRANSFER PRINTER

(75) Inventor: Daisuke Takasaka, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 251 days.

(21) Appl. No.: 11/126,922

(22) Filed: May 11, 2005

(65) Prior Publication Data

US 2005/0253918 A1 Nov. 17, 2005

(30) Foreign Application Priority Data

May 14, 2004 (JP) ..... 2004-144793

(51) Int. Cl.
*B41J 11/00* (2006.01)
*B41J 23/00* (2006.01)

(52) U.S. Cl. ..... 347/218

(58) Field of Classification Search ..... 347/218, 347/172, 174, 176; 400/634, 636
See application file for complete search history.

(56) References Cited

U.S. PATENT DOCUMENTS 6,622,582 B1 * 9/2003 Boyatt et al. ..... 74/410

FOREIGN PATENT DOCUMENTS

JP 62-22847 2/1987
JP 62-257868 11/1987
JP 11-160950 6/1999
JP 2002-111962 4/2002

OTHER PUBLICATIONS

Patent Abstracts of Japan, Publication No. 11-160950 dated Jun. 18, 1999, 1 page.
Office Action issued in Japanese Patent Application No. 2004-144793, mailed May 23, 2006 (4 pages).
Partial English Translation of Japanese Utility Model Laying-open No. 62-22847, dated Feb. 12, 1987 (3 pages).
Patent Abstracts of Japan, Publication No. 2002-111962, Publication Date Apr. 12, 2002, 1 page.
Patent Abstracts of Japan, Publication No. 62-257868, Publication Date Nov. 10, 1987, 1 page.

* cited by examiner

*Primary Examiner*—Huan Tran
(74) *Attorney, Agent, or Firm*—Osha Liang LLP

(57) ABSTRACT

A thermal transfer printer includes a sheet feed roller and a pinch roller cooperating to reciprocate a sheet, a motor providing the sheet feed roller with drive force, a thermal head 6 performing thermal transfer, and a controller controlling a series of operations. The sheet feed roller has a helical gear attached thereto to transmit the motor's drive force. In shifting from a sheet feeding operation to an image printing operation a reverse operation is performed to rotate the motor in a direction opposite to that of the sheet feeding operation, with the thermal head detached from the sheet, to previously offset the sheet together with thrust play of shaft.

4 Claims, 10 Drawing Sheets

THERMAL TRANSFER PRINTER

BACKGROUND OF THE INVENTION

1. Field of the Invention

The present invention relates generally to thermal transfer printers and particular to those pressing a thermal head against a sheet via an ink ribbon for thermal transfer.

2. Description of the Background Art

Among thermal transfer printers there is one employing an ink ribbon having yellow, magenta and cyan coloring regions and an overcoat region sequentially repeated and thermally transferred by a thermal head to a prescribed sheet to print an image in colors.

More specifically, a sheet feeding operation carrying the sheet toward the thermal head and an image printing operation sandwiching the ink ribbon between the carried sheet and the thermal head and carrying it in a direction opposite to the sheet feeding operation are performed in series repeatedly as corresponding to each coloring region of the ink ribbon. For example, if the above ink ribbon is used, the sheet will reciprocate four times.

In the sheet feeding operation the sheet is carried toward the thermal head, whereas in the image feeding operation the sheet is carried away from the thermal head. In that image feeding operation, an image will be printed on the sheet as it is carried such that it is pinched between the thermal head and a platen roller.

To reciprocate the sheet a sheet feed roller and a pinch roller are used such that the pinch roller is arranged opposite the sheet feed roller. The sheet feed roller serves as a driving roller and the pinch roller serves as a driven roller. The sheet is pinched between the sheet feed roller and the pinch roller and thus reciprocates. The driving roller or sheet feed roller will receive a motor's driving force via a prescribed gear. One such gear by way of example is a helical gear used for a driving roller's drive shaft, as described in Japanese Patent Laying-Open No. 11-160950.

Such thermal transfer printer operates, as will simply be described hereinafter. Initially, as shown in FIG. 18, in the sheet feeding operation a sheet 121 pinched between a sheet feed roller 102 and a pinch roller 104 is carried in a direction 132 as sheet feed roller 102 rotates in a direction 131. Subsequently when the sheet feeding operation completes, then as shown in FIG. 19, a thermal head 106 is pressed against sheet 121, with an ink ribbon (not shown) posed therebetween, and thus the sheet is pinched between thermal head 106 and a platen roller 108.

Then as sheet feed roller 102 rotates in a direction 134 sheet 121 pinched between thermal head 106 and platen roller 108 is carried in a direction 135, while thermal head 106 provides thermal transfer to perform the image printing operation printing an image on sheet 121. When a single image printing operation completes, the sheet feeding operation is again performed and the image printing operation is similarly performed for a subsequent color. Such an image printing operation is repeated in accordance with the ink ribbon's colors and an image is thus completely printed on the sheet.

The above described conventional thermal transfer printer, however, has the following disadvantage: to carry sheet 121, a motor (not shown) provides driving force which is in turn transmitted to sheet feed roller 102 via helical gear 114. The use of helical gear 114 contributes to limited thrust play of shaft along a longitudinal direction of a drive shaft rotating in one direction.

When the sheet feeding operation shifts to the image printing operation, however, the sheet feed roller 102 drive shaft starts to rotate in a direction opposite to that in which it rotates in the sheet feeding operation. Helical gear 114 can contribute to reduced thrust play of shaft for rotation in one direction, the gear cannot prevent thrust play of shaft when the rotation is stopped and reversed in direction.

Furthermore, when the sheet feeding operation shifts to the image printing operation, the sheet feed roller 102 drive shaft's rotation is reversed in direction 134 with sheet 121 and the ink ribbon pinched between thermal head 106 and platen roller 108. As such, with sheet 102 pinched by sheet feed roller 102 and pinch roller 104, the sheet feed roller 102 drive shaft would have thrust play of shaft in a direction 151 and sheet 121 experiences a force in a direction 141, as shown in FIG. 20.

Accordingly, sheet 121 to be carried in a direction 135 would be offset in an oblique direction 136 gradually as sheet feed roller 102 rotates, and between a sheet 121*a* immediately before the image printing operation and a sheet 121*b* after the image printing operation there will be an offset along the drive shaft (or direction 141).

As in the image printing operation sheet 121 would be offset in the thrust direction of sheet feed roller 102, an image printed on sheet 121 gradually offsets for example from a position X1 toward a position X2. In addition, this offset does not have reproducibility in degree and for each color of the ink ribbon the offset would vary in degree. This results in an offset in color providing an unclear image printed on the sheet.

If such offset in color is addressed by eliminating thrust play of shaft caused in reversing the helical gear's rotation, a thrust stopping washer or a similar, additional member is required.

SUMMARY OF THE INVENTION

The present invention has been made to overcome the above disadvantage and it contemplates a thermal transfer printer that can dispense with an additional member to clearly print an image on a sheet.

The present thermal transfer printer includes a sheet feed roller, a pinch roller, a motor, a helical gear, an ink ribbon for printing an image, a thermal head, a platen roller, and a controller. The sheet feed roller and the pinch roller face each other to pinch a sheet for reciprocating the sheet in a prescribed direction. The motor provides the sheet feed roller with drive force. The helical gear is provided at the sheet feed roller to receive the driver's drive force. The thermal head is pressed against the sheet carried by the sheet feed roller and the pinch roller, with the ink ribbon interposed, to thermally transfer a color of the ink ribbon. The platen roller faces the thermal head and cooperates with the thermal head to pinch the sheet and the ink ribbon to allow the sheet to be carried. The controller controls an operation of the motor and that of the thermal head. The controller includes a function performing a sheet feeding operation, a pressing operation, and an image printing operation. In the sheet printing operation the sheet feed roller and the pinch roller cooperate to carry the sheet toward the thermal head. In the pressing operation the thermal head is pressed against the carried sheet with the ink ribbon posed therebetween. In the image printing operation the sheet feed roller and the pinch roller cooperate to carry the sheet in a direction opposite to that of the sheet feeding operation with the thermal head press against the sheet to cause the thermal head to print an image on the sheet. The controller includes a function performing a reverse operation after the sheet feeding operation and before the pressing operation to previously rotate the sheet feed roller in a direction opposite to that of the sheet feeding operation with the thermal head detached from the sheet.

In shifting from the sheet feeding operation to the pressing operation for printing an image a reverse operation is performed to previously rotate the sheet feed roller in a direction opposite to that of the sheet feeding operation with the thermal head detached from the sheet. Thus in the image printing operation the sheet is not obliquely carried as the sheet feed roller rotates, as observed in a conventional thermal transfer printer. This can eliminate an offset in a thrust direction. As a result, the sheet feeding and image printing operations can repeatedly be performed for color image printing without color offset so that a clear image can be printed on the sheet.

The present invention provides another thermal transfer printer reciprocating a sheet in a prescribed direction to repeatedly perform a sheet feeding operation and an image printing operation and includes a carrier, a driver, a helical gear, a thermal head, and a controller. The carrier carries the sheet. The driver provides the carrier with drive force. The helical gear is provided at the carrier to transmit the driver's drive force. The thermal head is pressed against the sheet carried by the carrier with an ink ribbon posed therebetween to provide thermal transfer. The controller controls an operation of the driver and that of the thermal head. After the sheet is carried toward the thermal head, i.e., after the feeding operation, and before the thermal head is pressed against the sheet and the sheet is thus carried in a direction opposite to that of the sheet feeding operation while thermal transfer is provided, i.e., before the image printing operation, the controller has a function performing a reverse operation providing the carrier with rotational drive force opposite in direction to the sheet feeding operation with the thermal head detached from the sheet.

In shifting from the sheet feeding operation to the image printing operation a reverse operation is performed to previously rotate the sheet feed roller in a direction opposite to that of the sheet feeding operation with the thermal head detached from the sheet. Thus in the image printing operation the sheet is not obliquely carried as the sheet feed roller rotates, as observed in a conventional thermal transfer printer. This can eliminate an offset in a thrust direction. As a result, the sheet feeding and image printing operations can repeatedly be performed for color image printing without color offset so that a clear image can be printed on the sheet.

Preferably the carrier includes a driving roller having the helical gear attached thereto to receive force of rotation of the driver, and a first driven roller facing the driving roller and cooperating with the driving roller to pinch the sheet and rotating as the sheet pinched is carried.

This ensures that the sheet is carried.

Furthermore, preferably the thermal transfer printer further includes a second driven roller facing the thermal head and cooperating with the thermal head to pinch the sheet with an ink ribbon interposed, and rotating as the sheet pinched is carried.

This ensures that the sheet with the thermal head pressed thereto can be carried for the image printing operation.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
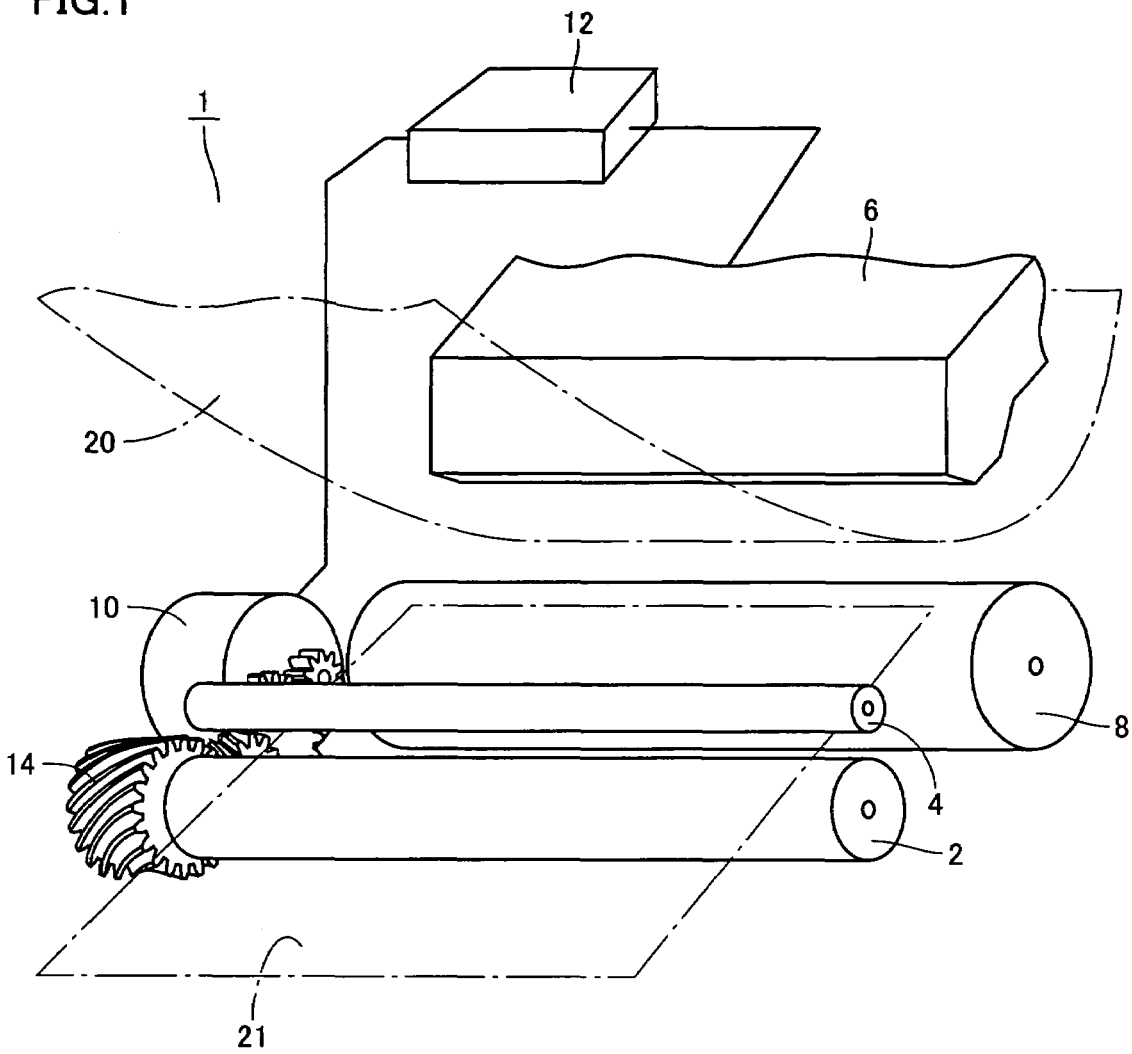
FIG. 1 is a perspective view of a main portion of the present thermal transfer printer in an embodiment.

The present embodiment provides a thermal transfer printer as will be described hereinafter. As shown in FIG. 1, a thermal transfer printer 1 includes a sheet feed roller 2 and a pinch roller 4 arranged opposite to pinch and thus reciprocate a sheet 21.

To provide sheet feed roller 2 with drive force a motor 10 is arranged. Sheet feed roller 2 has a helical gear 14 attached thereto to transmit the motor 10 drive force. Pinch roller 4 cooperates with sheet feed roller 2 to pinch sheet 21 and is driven to rotate as sheet 21 is carried.

Figure 2:
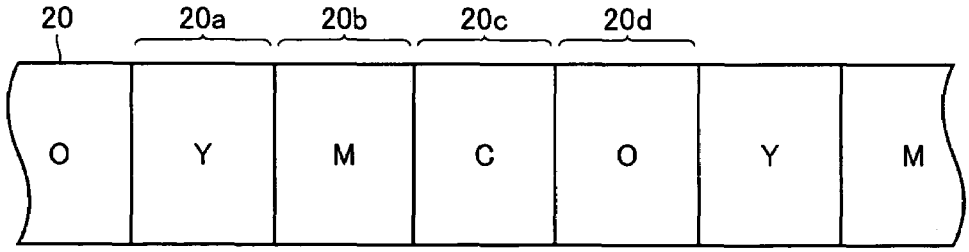
FIG. 2 is a plan view for illustrating an arrangement of colors of an ink ribbon applied to the thermal transfer printer in the embodiment.

In a vicinity of pinch roller 4 is arranged a thermal head 6 pressed against sheet 21 with ink ribbon 20 posed therebetween for thermal transfer. Ink ribbon 20 is as shown in FIG. 2, having a yellow region 20*a* (Y), a magenta region

20*b* (M) and a cyan region 20*c* (C) corresponding to coloring regions, and an overcoat region 20*d* (O) sequentially repeated.

Thermal head 6 faces a platen roller 8 cooperating with thermal head 6 to pinch ink ribbon 20 and sheet 21 and driven to rotate as sheet 21 is carried, and a controller 12 is provided to control a series of operations of thermal transfer print 1 including those of motor 10 and thermal head 6.

Figure 3:
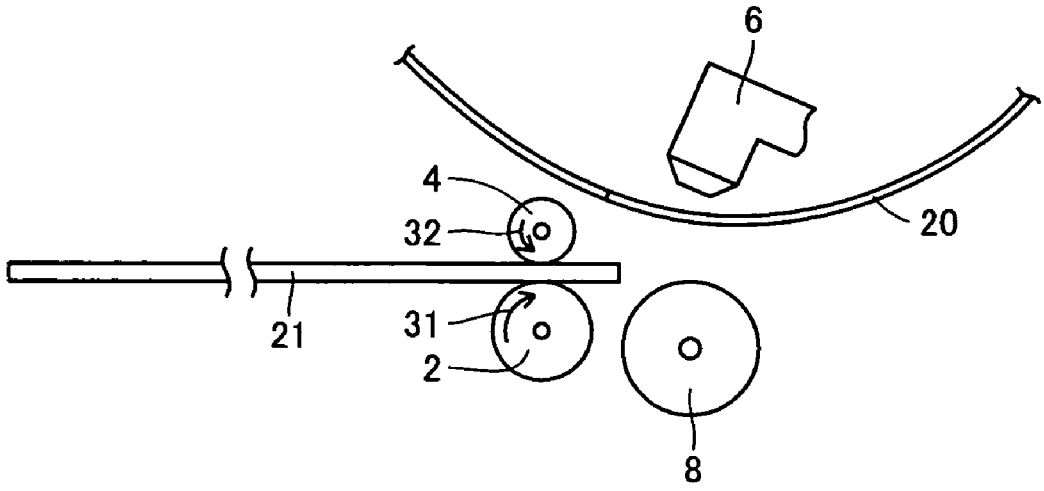
FIG. 3 is a partial side view for illustrating an operation for illustrating a series of operations of the thermal transfer printer in the embodiment.
Figure 4:
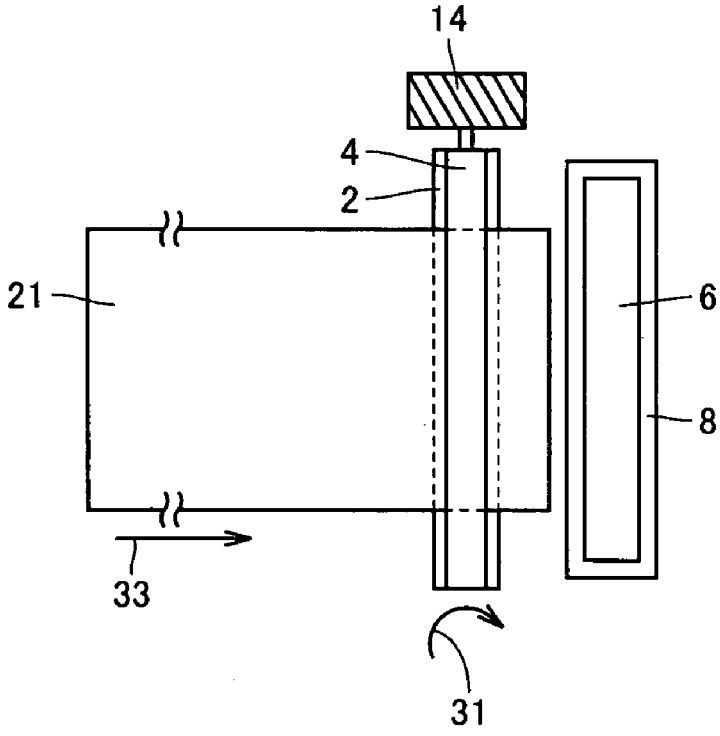
FIG. 4 is a partial plan view in the FIG. 3 operation in the embodiment.

The above described thermal transfer print 1 operates as will be described hereinafter. Initially, with reference to FIGS. 3 and 4, the motor's drive force is transmitted via the helical gear to sheet feed roller 2 to rotate sheet feed roller 2 in a direction 31. As sheet feed roller 2 rotates, sheet 21 pinched between sheet feed roller 2 and pinch roller 4 is carried toward thermal head 6 in a direction 33. A sheet feeding operation is thus performed. Note that pinch roller 4 is driven to rotate in a direction 32 through force of friction with sheet 21. Sheet 21 can thus be carried with precision.

Figure 5:
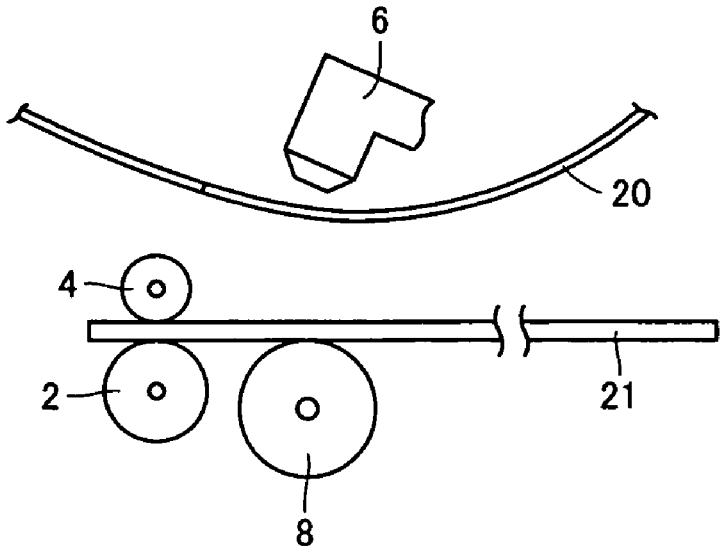
FIG. 5 is a partial side view for illustrating an operation subsequent to the FIG. 3 operation in the embodiment.
Figure 6:
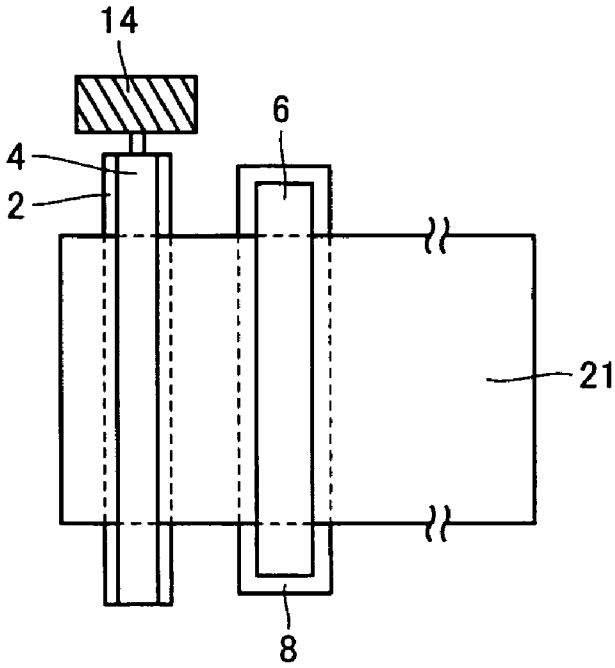
FIG. 6 is a partial plan view in the FIG. 5 operation in the embodiment.
Figure 7:
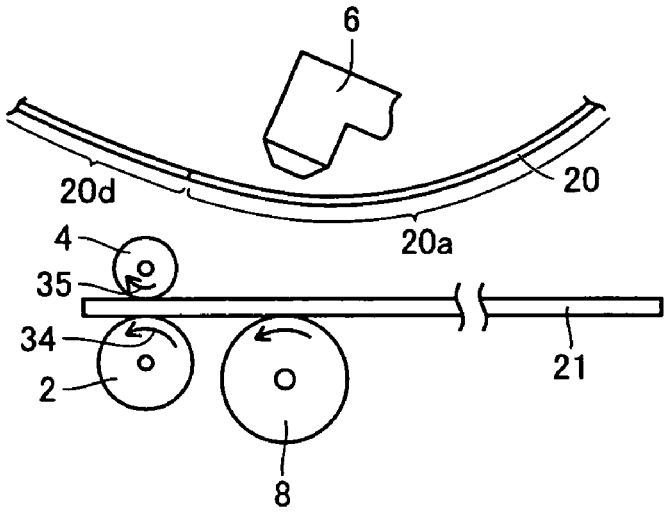
FIG. 7 is a partial side view for illustrating an operation subsequent to the FIG. 5 operation in the embodiment.

Then, as shown in FIGS. 5 and 6, when sheet 21 is carried to a prescribed position relative to thermal head 6, the motor stops driving and sheet 21 accordingly stops. Then, as shown in FIG. 7, without thermal head 6 pressed against sheet 21, controller 12 provides a reverse operation driving the motor to rotate in a direction opposite to that of the sheet feeding operation.

In the reverse operation the motor's rotational drive force is transmitted via the helical gear to sheet feed roller 2 to start to rotate sheet feed roller 2 in a direction 34, while force of friction with sheet 21 causes pinch roller 4 to rotate in a direction 35. As the helical gear receives the rotational drive force opposite in direction to the sheet feeding operation, sheet feed roller 2 has thrust play of shaft along the drive shaft.

As thermal head 6 is not pressed against sheet 21 and sheet 21 is simply pinched between sheet feed roller 2 and pinch roller 4, sheet 21 will be offset together with the thrust play of shaft of the roller 2 drive shaft.

Figure 8:
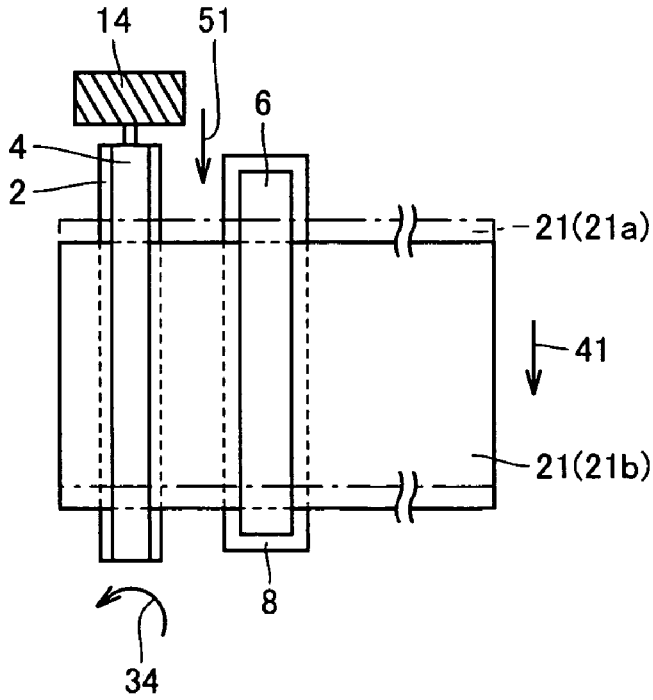
FIG. 8 is a partial plan view in the FIG. 7 operation in the embodiment.

More specifically, such a reverse operation performed for a completely fed sheet, or sheet 21*a*, will cause the entirety of sheet 21 to be previously offset together with the roller 2 thrust play of shaft from the position of sheet 21*a* to that of sheet 21*b*, as shown in FIG. 8.

Figure 9:
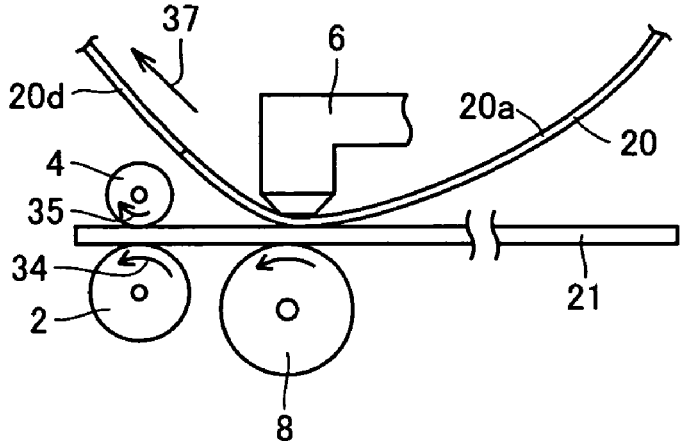
FIG. 9 is a partial side view for illustrating an operation subsequent to the FIG. 7 operation in the embodiment.
Figure 10:
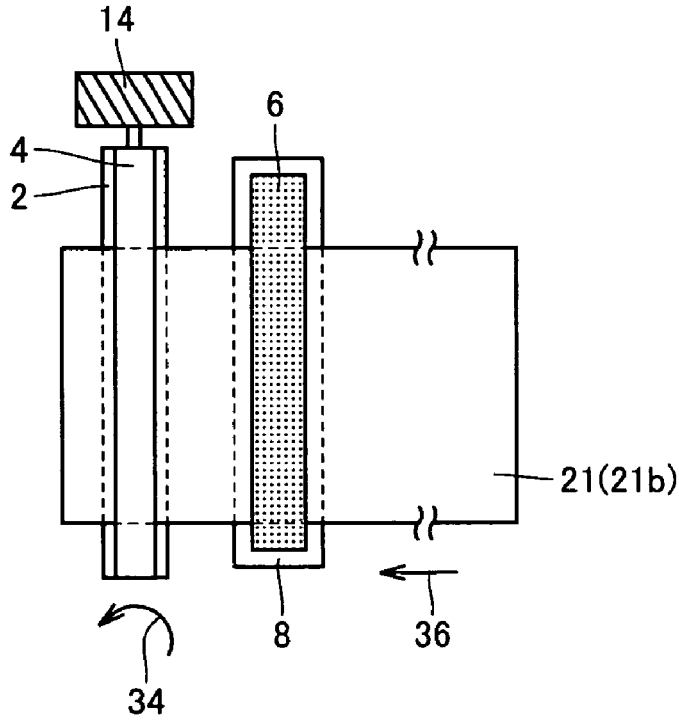
FIG. 10 is a partial plan view in the FIG. 9 operation in the embodiment.

Then, as shown in FIGS. 9 and 10, sheet feed roller 2 is rotated in direction 34 while and thermal head 6 is pressed against sheet 21 with ink ribbon 20 interposed, and with thermal head 6 and platen roller 8 sandwiching ink ribbon 20 and sheet 21, sheet 21 is carried in a direction 36 opposite to that of the sheet feeding operation while thermal head 6 provides thermal transfer to perform the image printing operation. As sheet 21 is carried ink ribbon 20 also moves in accordance therewith in a direction 37 to perform the image printing operation with yellow region 20*a*.

Figure 11:
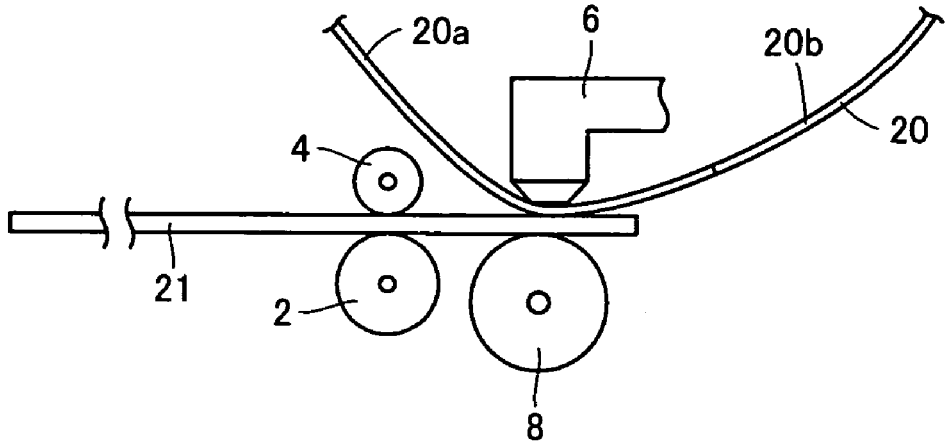
FIG. 11 is a partial side view for illustrating an operation subsequent to the FIG. 9 operation in the embodiment.
Figure 12:
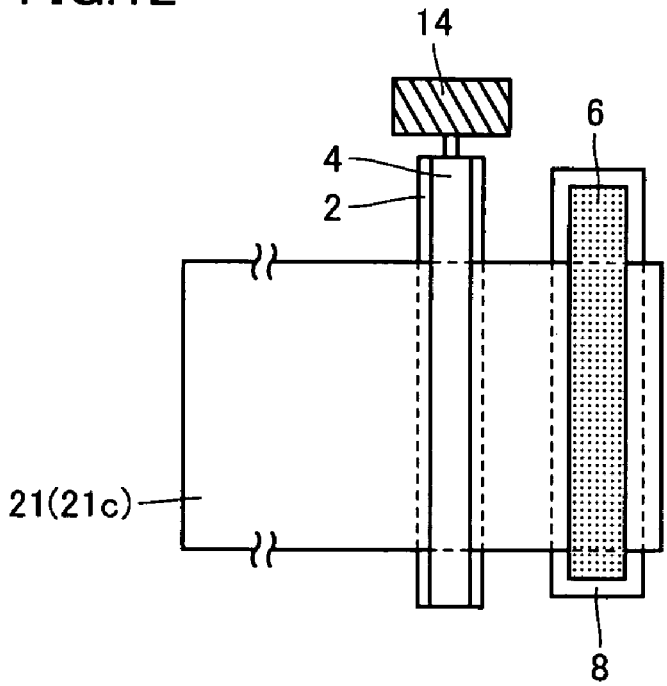
FIG. 12 is a partial plan view in the FIG. 11 operation in the embodiment.

When the image printing operation with yellow region 20*a* thus completes, the motor stops driving and sheet 21 accordingly stops, as shown in FIGS. 11 and 12. Thereafter, thermal head 6 is detached from sheet 21. When the image printing operation completes, sheet 21 is located at the position of a sheet 21*c*. Furthermore in this image printing operation platen roller 8 is rotatably driven by force of friction with sheet 21 so that in the image printing operation sheet 21 can precisely be carried.

Figure 13:
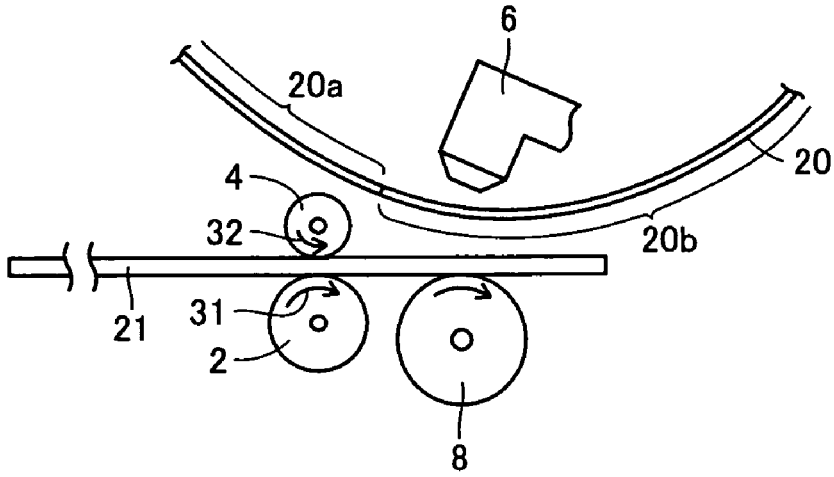
FIG. 13 is a partial side view for illustrating an operation subsequent to the FIG. 11 operation in the embodiment.

Then, as shown in FIG. 13, without thermal head 6 pressed against sheet 21, the motor is driven to rotate in the direction of the sheet feeding operation to shift from the image printing operation to the sheet feeding operation. The motor's drive force is transmitted via the helical gear to sheet feed roller 2 to start to rotate sheet feed roller 2 in direction 31. As the helical gear receives rotational drive force opposite in direction to the image printing operation, the roller 2 drive shaft experiences thrust play of shaft.

Figure 14:
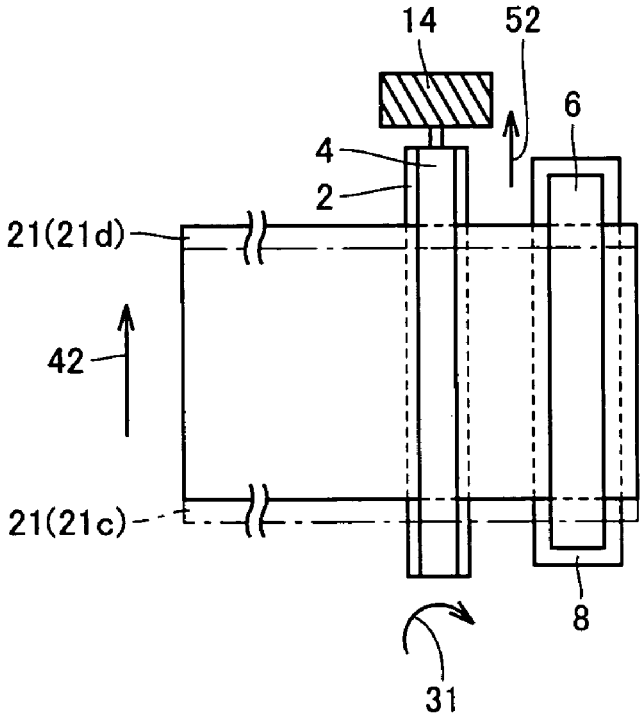
FIG. 14 is a partial plan view in the FIG. 13 operation in the embodiment.

As thermal head 6 is not pressed against sheet 21 and sheet 21 is simply pinched between sheet feed roller 2 and pinch roller 4, sheet 21 will be offset together with the thrust play of shaft of the roller 2 drive shaft. Furthermore, this thrust play of shaft is caused in a direction opposite to that (or a direction 51) of thrust play of shaft caused when the sheet feeding operation shifts to the image printing operation. Thus, as shown in FIG. 14, the entirety of sheet 21 will be offset together with thrust play of shaft from the position of sheet 21*c* provided upon completion of a single image printing operation to that of a sheet 21*d*.

Figure 15:
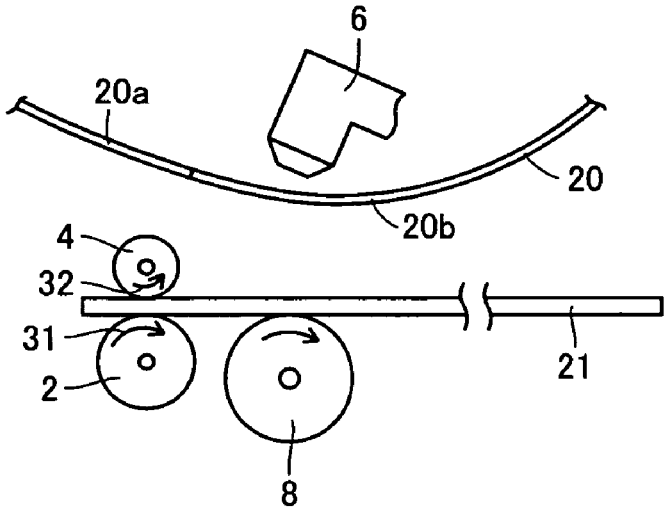
FIG. 15 is a partial side view for illustrating an operation subsequent to the FIG. 13 operation in the embodiment.
Figure 16:
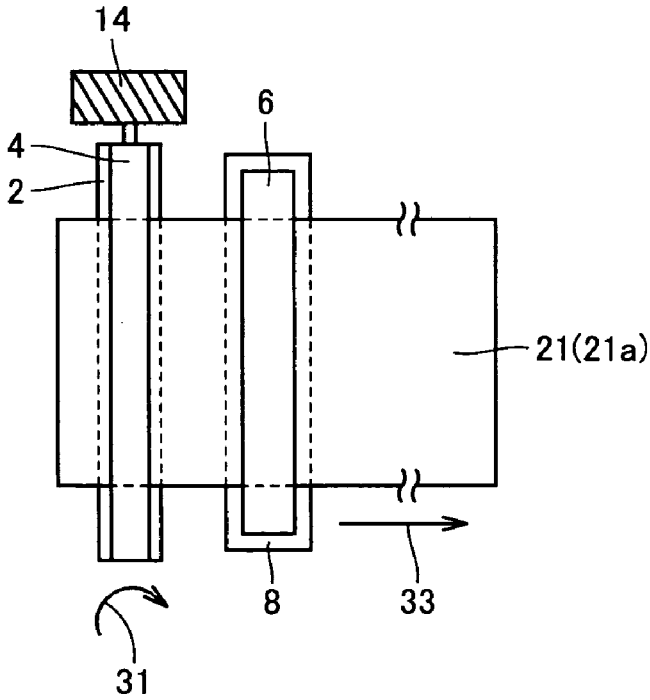
FIG. 16 is a partial plan view in the FIG. 15 operation in the embodiment.

Then, as shown in FIGS. 15 and 16, as sheet feed roller 2 rotates in direction 31, sheet 21 pinched by sheet feed roller 2 and pinch roller 4 is carried toward thermal head 6 in direction 33 to perform the sheet feeding operation. When the sheet feeding operation completes, the motor stops driving and sheet 21 accordingly stops to provide the same condition shown in FIGS. 5 and 6.

Then, similarly as has been shown in FIGS. 7 and 8, in shifting from the sheet reading operation to the image printing operation a reverse operation is performed, without thermal head 6 pressed against the sheet, to previously offset the entirety of sheet 21 together with thrust play of shaft caused at sheet feed roller 2. By this reverse operation, sheet 21*a* shown in FIG. 16 is previously offset to the same position as sheet 21*b* shown in FIG. 8.

Then, similarly as has been shown in FIGS. 9 and 10, ink ribbon 20 has the subsequent magenta region 20*b* thermally transferred to perform the image printing operation. When this image printing operation completes, sheet 21 is located at the same position as sheet 21*c* shown in FIG. 12 or 14.

For the ink ribbon 20 cyan region 20*c* the above described, series of sheet feeding and image printing operations is performed to provide thermal transfer, and finally for the ink ribbon 20 overcoat region 20*d* the sheet feeding and image printing operations are performed to overcoat sheet 21 to complete printing an image on the sheet. Sheet 21 with an image having been printed thereon will be discharged from the thermal transfer printer.

When the above described thermal transfer printer shifts from the sheet feeding operation through pressing thermal head 6 against sheet 21 to the image printing operation, controller 12 reverses the sheet feed roller 2 rotation without thermal head 6 pressed against sheet 21. This reverse operation will previously offset the entirety of sheet 21 together with thrust play of shaft caused at sheet feed roller 2. Thus subsequently when thermal head 6 is pressed against sheet 21 to perform the image printing operation it is not affected by thrust play of shaft as in a conventional thermal transfer printer, and sheet 21 will not obliquely be carried as sheet feed roller 2 rotates.

Figure 17:
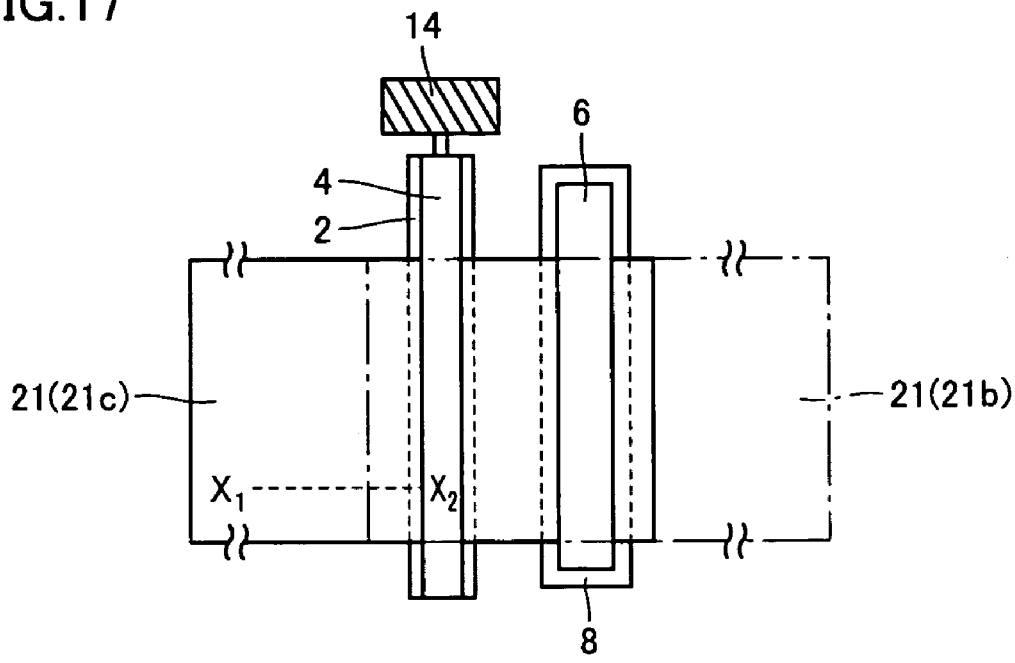
FIG. 17 is a partial plan view for illustrating an image printing operation performed by the thermal transfer printer in the embodiment.
Figure 18:
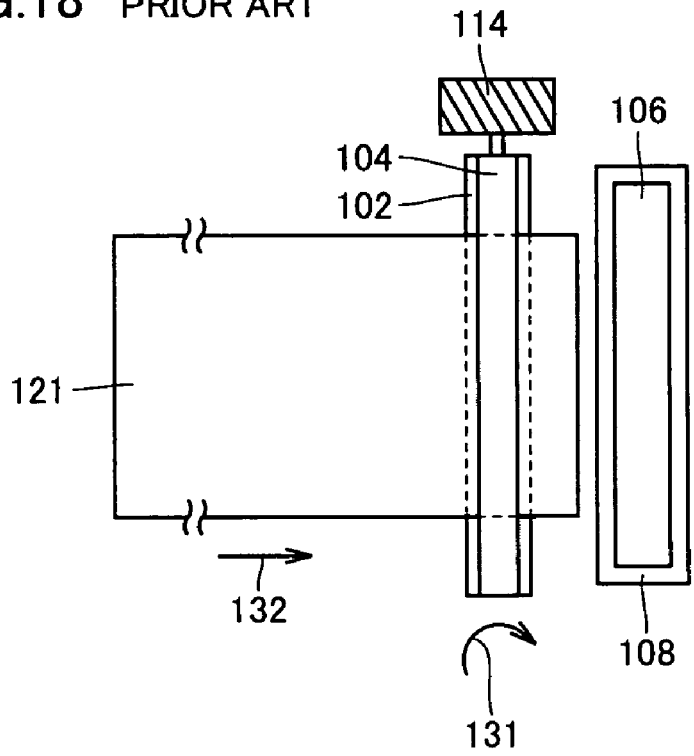
FIG.18 PRIOR ART
FIG. 18 is a partial plan view for illustrating an operation for illustrating an operation of a conventional thermal transfer printer.
Figure 19:
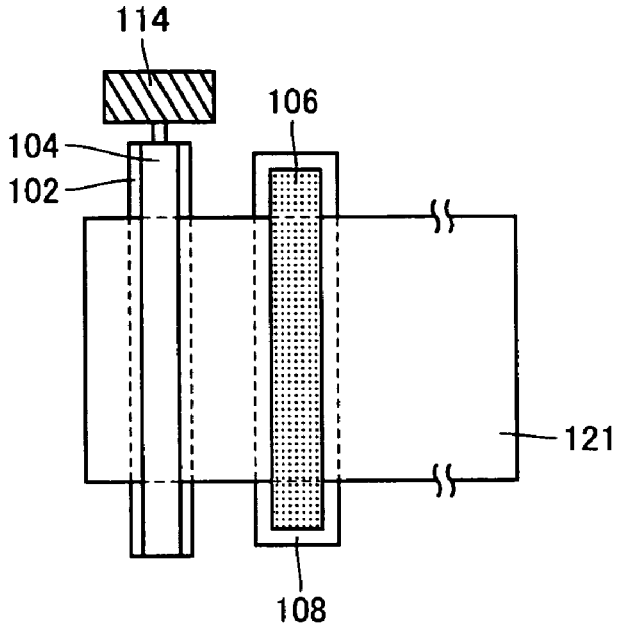
FIG.19 PRIOR ART
FIG. 19 is a partial plan view for illustrating an operation subsequent to the FIG. 18 operation.
Figure 20:
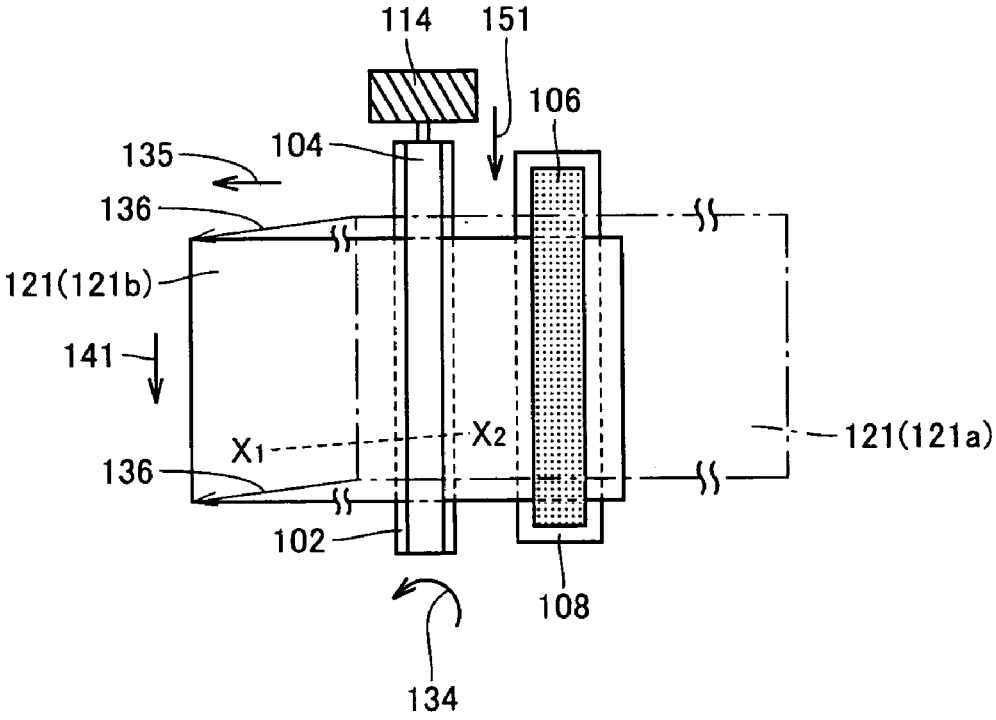
FIG.20 PRIOR ART
FIG. 20 is a partial plan view for illustrating an image printing operation of the conventional thermal transfer printer.

Consequently, as shown in FIG. 17, in a single image printing operation sheet 21 is not offset in a thrust direction. Sheet 21 can be transmitted from the position of sheet 21*b* toward that of sheet 21*c* precisely and an image to be printed for example from position X1 toward position X2 can be printed without oblique offset.

In addition thereto, in the image printing operation for any of yellow, magenta and cyan regions 20*a*, 20*b* and 20*c* of ink ribbon 20 sheet 21 can also be carried precisely from the position of sheet 21*b* toward that of sheet 21*c* so that colors will not be offset and an image can be printed clearly.

Thus in the present thermal transfer printer a controller performs a reverse operation after a sheet feeding operation and before an image printing operation to eliminate the necessity of introducing an additional member to readily eliminate color offset to print an image on a sheet clearly.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermal transfer printer comprising:

a sheet feed roller and a pinch roller facing each other to pinch a sheet for reciprocating said sheet in a prescribed direction;

a motor providing said sheet feed roller with drive force;

a helical gear provided to said sheet feed roller to receive said motor's drive force;

an ink ribbon used to print an image;

a thermal head pressed against said sheet carried by said sheet feed roller and said pinch roller, with said ink ribbon interposed, to thermally transfer a color of said ink ribbon;

a platen roller facing said thermal head and cooperating with said thermal head to pinch said sheet and said ink ribbon to allow said sheet to be carried; and a controller controlling an operation of said motor and that of said thermal head, wherein:

said controller includes a function performing a sheet feeding operation performed via said sheet feed roller and said pinch roller to carry said sheet toward said thermal head, a pressing operation pressing said thermal head against said sheet with said ink ribbon posed therebetween, and an image printing operation printing an image on said sheet by said thermal head pressed against said sheet as said sheet feed roller and said pinch roller carry said sheet in a direction opposite to that of said sheet feeding operation, and includes a function performing a reverse operation after said sheet feeding operation and before said pressing operation to previously rotate said sheet feed roller in a direction opposite to that of said sheet feeding operation with said thermal head detached from said sheet.

2. A thermal transfer printer reciprocating a sheet in a prescribed direction to repeatedly perform a sheet feeding operation and an image printing operation, comprising:

a carrier carrying said sheet;

a driver providing said carrier with drive force;

a helical gear provided at said carrier to transmit said driver's drive force;

a thermal head pressed against said sheet carried by said carrier with an ink ribbon posed therebetween to provide thermal transfer; and a controller controlling an operation of said driver and that of said thermal head, wherein after said sheet is carried toward said thermal head and before said thermal head is pressed against said sheet and said sheet is thus carried in a direction opposite to that of said sheet feeding operation while thermal transfer is provided, said controller has a function performing a reverse operation providing said carrier with rotational drive force opposite in direction to said sheet feeding operation with said thermal head detached from said sheet.

3. The thermal transfer printer of claim 2, wherein said carrier includes:

a driving roller having said helical gear attached thereto to receive force of rotation of said driver; and a first driven roller facing said driving roller and cooperating with said driving roller to pinch said sheet and rotating as said sheet pinched is carried.

4. The thermal transfer printer of claim 2, further comprising a second driven roller facing said thermal head and cooperating with said thermal head to pinch said sheet with an ink ribbon interposed, and rotating as said sheet pinched is carried.

* * * * *